US008313188B2

(12) United States Patent
Muro et al.

(10) Patent No.: US 8,313,188 B2
(45) Date of Patent: Nov. 20, 2012

(54) INK JET PRINTING APPARATUS AND DRYING CONTROL METHOD FOR THE SAME

(75) Inventors: Kentarou Muro, Tokyo (JP); Tsuyoshi Kanke, Yokohama (JP); Riichi Saito, Fujisawa (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 12/876,436

(22) Filed: Sep. 7, 2010

(65) Prior Publication Data

US 2011/0063358 A1 Mar. 17, 2011

(30) Foreign Application Priority Data

Sep. 14, 2009 (JP) ..... 2009-211843

(51) Int. Cl.
*B41J 2/01* (2006.01)

(52) U.S. Cl. ..... 347/102

(58) Field of Classification Search ..... 347/17, 347/102, 104
See application file for complete search history.

(56) References Cited

U.S. PATENT DOCUMENTS

| | | | | |
|---|---|---|---|---|
| 5,502,464 | A | 3/1996 | Takahashi et al. | |
| 7,004,578 | B2 | 2/2006 | Tsuboi et al. | |
| 7,210,775 | B2 * | 5/2007 | Hoshino | 347/102 |

FOREIGN PATENT DOCUMENTS

| | | | |
|---|---|---|---|
| JP | 2001-058398 | A | 3/2001 |
| JP | 2002-268196 | A | 9/2002 |
| JP | 2002-337331 | A | 11/2002 |
| JP | 2006-341399 | A | 12/2006 |

* cited by examiner

*Primary Examiner* — An Do
(74) *Attorney, Agent, or Firm* — Fitzpatrick, Cella, Harper & Scinto

(57) ABSTRACT

An ink jet printing apparatus according to the present invention includes a dryer configured to dry ink on a print medium. The dryer includes a heating unit configured to heat air in the dryer, and an outside air adjustment mechanism configured to adjust the amount of outside air introduced into the dryer. When the outside air adjustment mechanism is controlled so that the outside air introduction amount is increased, before the control of the outside air introduction amount, the heating unit is controlled so that heated air heated by the heating unit is preheated to a second target temperature higher than a predetermined first target temperature for a normal operation. Even if the outside air introduction amount is actually increased to temporarily reduce the temperature of heated air, the temperature of the heated air can be maintained at a value required for sufficient drying.

8 Claims, 10 Drawing Sheets

| DROPLET SHOOT AMOUNT | SECOND TARGET TEMPERATURE [℃] | OUTSIDE AIR INTRODUCTION AMOUNT [$m^3$/min] |
|---|---|---|
| SMALL | 80 | 0.5 |
| MEDIUM | 85 | 1 |
| LARGE | 90 | 2 |

FIG.4

INK JET PRINTING APPARATUS AND DRYING CONTROL METHOD FOR THE SAME

BACKGROUND OF THE INVENTION

1. Field of the Invention

The present invention relates to an ink jet printing apparatus, and in particular, to an ink jet printing apparatus including a dryer configured to dry ink on a print medium and a drying control method for the ink jet printing apparatus.

2. Description of the Related Art

Various dryers have been put to practical use which are configured to dry ink jet print media, photographic print paper, and the like with images printed thereon by image recording apparatuses such as ink jet printers or photographic photosensitive apparatuses. In these dryers, a temperature sensor is installed, and a fan is provided to blow air (hot air) heated by a heater against a print medium. A dryer control section, for example, controllably turns on and off the heater to maintain the temperature of the hot air at a predetermined value. The dryer control section thus dries the print medium being conveyed.

In a dryer that uses hot air, energy efficiency can be increased by making the dryer more properly closed and reducing heat leakage to the exterior. However, continuous drying may increase the humidity in the dryer to degrade drying capability. Moreover, if print media larger than standard ones are dried, the amount of moisture to be evaporated increases, thus making humidity likely to increase. This may result in an increase in outside air introduction amount. On the other hand, when a large amount of outside air is always introduced into the dryer so as to deal with large-sized print media, the heater consumes more power in order to maintain the temperature. This reduces the energy efficiency.

In a dryer disclosed in Japanese Patent Laid-Open No. 2002-268196, introduction of outside air into the dryer is avoided for a normal operation. When sheets of a size larger than a standard one are dried, outside air is introduced in order to increase air volume. This prevents the power consumption from being needlessly increased. Thus, energy saving is expected to be achieved.

If outside air the temperature of which is lower than that in the dryer is introduced, immediately after introduction of the outside air is started or the outside air introduction amount is increased, the temperature in the dryer decreases temporarily. For energy saving, the outside air introduction amount is preferably increased for print media larger than normal ones or print media with a large amount of moisture. However, in this case, immediately after the outside air introduction amount is increased, the temperature decreases by a larger amount. This may temporarily preclude sufficient drying.

Thus, the present invention has been developed in view of the above-described circumstances. An object of the present invention is to provide an ink jet printing apparatus and a drying control method for the ink jet printing apparatus in which when the outside air introduction amount is increased, degradation of the drying capability is suppressed.

SUMMARY OF THE INVENTION

An aspect of the present invention provides an ink jet printing apparatus comprising:

a printing section configured to allow a print head to eject ink droplets onto a print medium to form an image;

a dryer configured to dry the ink on the print medium conveyed from the printing section; and a control unit configured to control a heating unit configured to heat air in the dryer, and an outside air adjustment mechanism configured to adjust the amount of outside air introduced into the dryer;

wherein the control unit is able to perform a mode for controlling the heating unit so that temperature in the dryer is set to a first target temperature without changing an outside air introduction amount by the outside air adjustment mechanism, and a mode for controlling the heating unit so that the temperature in the dryer is pre-raised to a second target temperature higher than the first target temperature before the outside air introduction amount is increased by the outside air adjustment mechanism.

Thus, before the outside air introduction amount is increased, the temperature in the dryer is pre-raised to the second target temperature. Hence, even if the temperature in the dryer decreases temporarily as a result of an increase in outside air introduction amount, the temperature in the dryer can be maintained at the value at which sufficient drying can be achieved. As a result, degradation of the drying capability can be suppressed.

Preferably, the control unit controls the outside air adjustment mechanism so that the outside air introduction amount is increased either when the dryer is started up or when an ink droplet ejection amount increases or when the size of the print medium is increased.

Preferably, the control unit increases the second target temperature consistently with the ink droplet ejection amount.

Preferably, the control unit controls the outside air adjustment mechanism so that the outside air introduction amount is increased when the temperature in the dryer reaches the second target temperature, and thereafter, the control unit controls the heating unit so that the temperature in the dryer is set to the first target temperature.

Preferably, the ink jet printing apparatus further comprises a temperature detection unit configured to detect the temperature in the dryer, and wherein the control unit feedback-controls the heating unit based on the temperature detected by the temperature detection unit.

Preferably, the dryer further comprises a shutter mechanism configured to open and close at least one of an inlet and an outlet through which the print medium passes, in accordance with the size of the print medium.

Another aspect of the present invention provides a drying control method for an ink jet printing apparatus comprising a printing section configured to allow a print head to eject ink droplets onto a print medium to form an image, a dryer configured to dry the ink on the print medium conveyed from the printing section, a heating unit configured to heat air in the dryer, and an outside air adjustment mechanism configured to adjust the amount of outside air introduced into the dryer, the method comprising:

a step of heating the air in the dryer by the heating unit so that temperature in the dryer is set to a first target temperature without changing an outside air introduction amount by the outside air adjustment mechanism; and a step of heating the air in the dryer by the heating unit so that the temperature in the dryer is set to a second target temperature before the outside air introduction amount is increased by the outside air adjustment mechanism;

wherein the second target temperature is higher than the first target temperature.

The present invention exerts an excellent effect of suppressing degradation of the drying capability when the amount of outside air introduced into the dryer is increased.

Further features of the present invention will become apparent from the following description of exemplary embodiments with reference to the attached drawings.

BRIEF DESCRIPTION OF THE DRAWINGS

FIG. 4 is a map showing the relationship between a droplet shoot amount and each of a second target temperature and an outside air introduction amount;

DESCRIPTION OF THE EMBODIMENTS

A preferred embodiment of the present invention will be described below with reference to the attached drawings.

Figure 1:
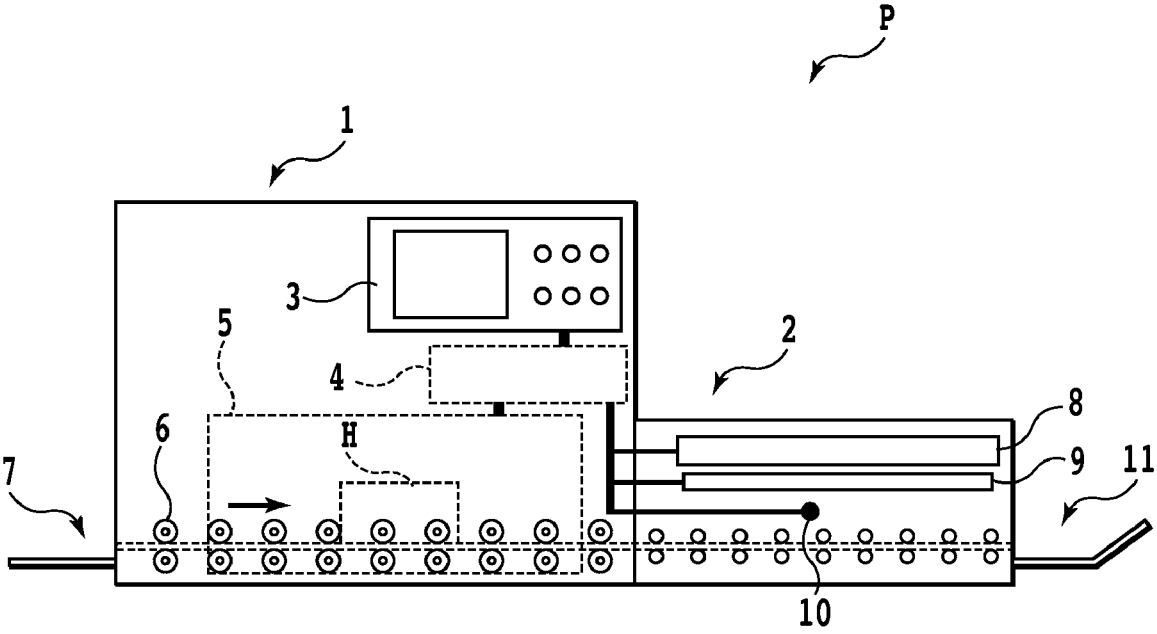
FIG. 1 is a schematic diagram of an ink jet printing apparatus according to an embodiment of the present invention.

FIG. 1 shows an ink jet printing apparatus according to the present embodiment. The ink jet printing apparatus P includes an ink jet print head H. Ink droplets are ejected from the print head H onto a print medium such as plain paper or glossy paper to form an image on the print medium (denoted by reference numeral 13 in FIG. 2). The ink jet printing apparatus P includes an apparatus main body 1 configured to accommodate a print unit 5 as a printing section including the print head H, and a dryer 2 located adjacent to the apparatus main body 1. The ink jet printing apparatus P conveys the print medium 13 with an image recorded or printed by the apparatus main body 1, to the dryer 2 via a plurality of conveyance rollers 6. In the dryer 2, the ink on the print medium 13 is dried, and the print medium 13 is discharged to a discharge section 11. The print medium 13 is fed from a supply section 7 into the apparatus main body 1 via the conveyance rollers 6. The conveying direction of the print medium 13 is shown by an arrow in FIG. 1.

The apparatus main body 1 includes a control device 4 as a control unit and a control panel 3 configured to display information to a user. The print unit 5 and the control panel 3 are connected to the control device 4.

Figure 2:
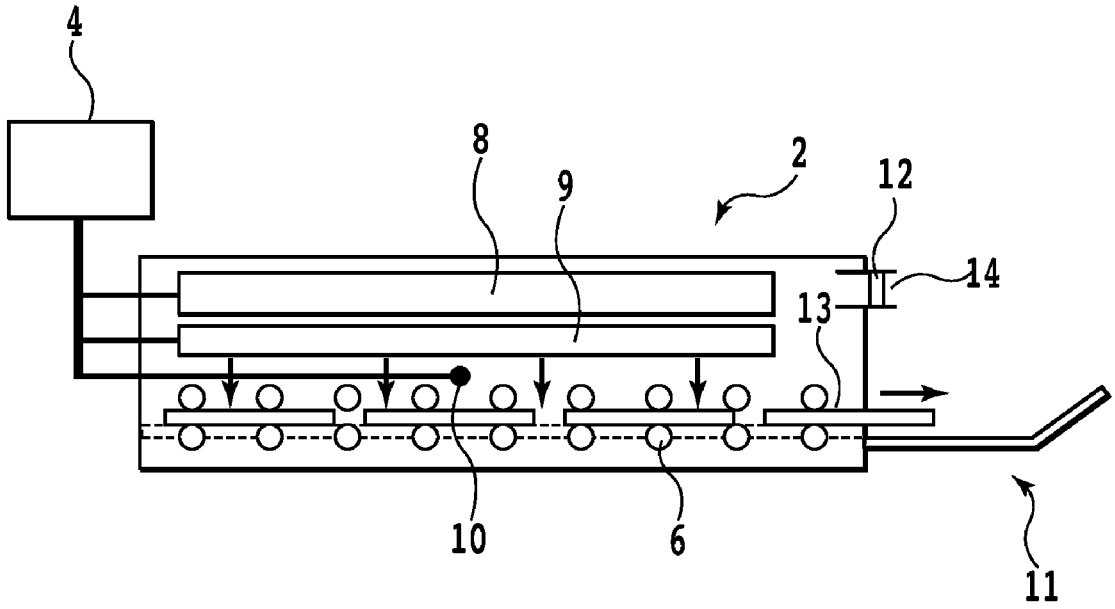
FIG. 2 is a schematic sectional view of a dryer.

As shown in FIG. 2, a heater 9 (heating unit), a fan 8, and a temperature sensor 10 (temperature detection unit) are installed inside the dryer 2. The heater 9 heats the air in the dryer 2. The fan 8 blows the heated air downward against the top surface, that is, the ink ejection surface of the print medium 13. The ink on the print medium 13 is then dried. The temperature sensor 10 detects the temperature of hot air blown against the print medium 13. The heated air is hereinafter also referred to as hot air. The ink droplets ejected onto the print medium are hereinafter also referred to as droplets. Ejecting ink droplets onto the print medium is hereinafter also referred to as "shooting" ink droplets onto the print medium.

Furthermore, the dryer 2 includes an outside air introduction port 14 and an outside air adjustment mechanism 12 provided in the outside introduction port 14 to adjust the amount of outside air introduced into the dryer 2.

Figure 3A:
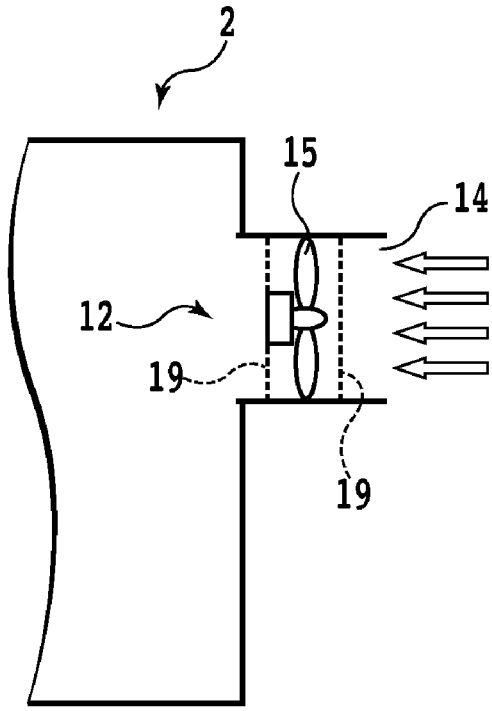
FIGS. 3A and 3B are schematic sectional views of outside air adjustment mechanisms.
Figure 3B:
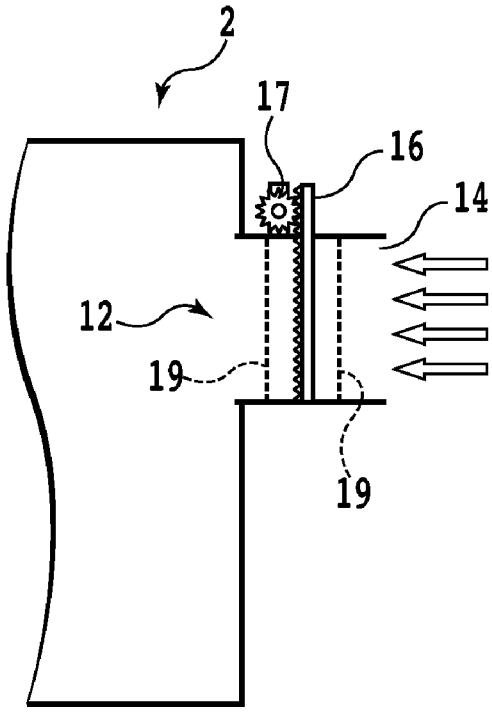

FIGS. 3A and 3B show the outside air adjustment mechanism 12. In the example shown in FIG. 3A, the outside air adjustment mechanism 12 includes an electric fan 15 so that the rotation speed of the electric fan 15 is varied to adjust the outside air introduction amount. The electric fan 15 has its rotation speed controlled by the control device 4; the control speed is increased to increase the outside air introduction amount and reduced to decrease the outside air introduction amount. In a stopped (or halted) state, the electric fan 15 is stopped. When the electric fan 15 is stopped, outside air can be in actuality introduced through gaps in the fan. However, this amount of outside air introduced is small and is thus considered to be zero for convenience. Filters 19 configured to prevent entry of dust or the like mixed in the outside air are provided before and after the electric fan 15.

In the example shown in FIG. 3B, the outside air adjustment mechanism 12 includes a shutter valve 16 that can be projected from and retracted into the outside air introduction port 14, and a driving motor 17 configured to drive the shutter valve 16. The shutter valve 16 is driven by the driving motor 17 via a rack and pinion mechanism. The opening degree of the shutter valve 16 is varied to adjust the outside air introduction amount. The driving motor 17 has its rotation phase controlled by the control device 4. To increase the outside air introduction amount, the driving motor 17 is rotationally driven in the direction in which the opening degree of the shutter valve increases. To reduce the outside air introduction amount, the driving motor 17 is rotationally driven in the direction in which the opening degree of the shutter valve decreases. In the stopped state, the shutter valve 16 is fully closed to set the outside air introduction amount to zero. Filters 19 similar to those described above are provided before and after the shutter valve 16.

During a normal operation, the control device 4 feedback-controls the heater 9 so that the hot air temperature detected by the temperature sensor 10 is equal to a predetermined first target temperature T1. The first target temperature is, for example, 60° C. On the other hand, in controlling the outside air adjustment mechanism 12 so that the outside air introduction amount is increased, before the control of the outside air introduction amount, the control unit 4 feedback-controls the heater 9 so that the hot air is preheated to a predetermined second target temperature T2 higher than the first target temperature T1.

More specifically, in accordance with such a map as shown in FIG. 4, the map being pre-stored in a memory for the control device 4, the control device 4 controls the heater 9 and the outside air adjustment mechanism 12 and thus the hot air temperature and the outside air introduction amount. The second target temperature T2 and the outside air introduction amount (target value) increase consistently with the amount of ink droplets ejected onto the print medium, that is, the droplet shoot amount. Here, the droplet shoot amount is classified into three levels, small, medium, and large, and the corresponding three second target temperatures T and amounts of outside air introductions are set. However, the present invention is not limited to this example. The amounts can be classified into more levels or set to be level-less. Numeral values are also illustrative and can be optionally changed.

For example, when the droplet shoot amount changes from the small level to the medium level, the outside air introduction amount is increased from 0.5 ($m^3$/min) to 1 ($m^3$/min). Furthermore, the second target temperature T2 increases from 80(° C.) to 85(° C.).

The outside air introduction amount increases consistently with the droplet shoot amount. Thus, even if much moisture is generated in the dryer 2, an increase in the humidity in the dryer 2 can be suppressed, enabling the required drying capability to be maintained. On the other hand, an increase in outside air introduction amount temporarily reduces the temperature of the hot air in the dryer 2. Thus, in the present embodiment, before an actual increase in outside air introduction amount, the hot air temperature is increased to the second target temperature T2, which is higher than the first target temperature T1. Then, even if the outside air introduction amount is increased to temporarily reduce the hot air temperature, the hot air can be maintained nearly at the first target temperature T1, at which sufficient drying can be achieved. Thus, degradation of the drying capability can be suppressed.

The reason for an increase in second target temperature T2 consistent with the droplet shoot amount will be described below.

Figure 5:
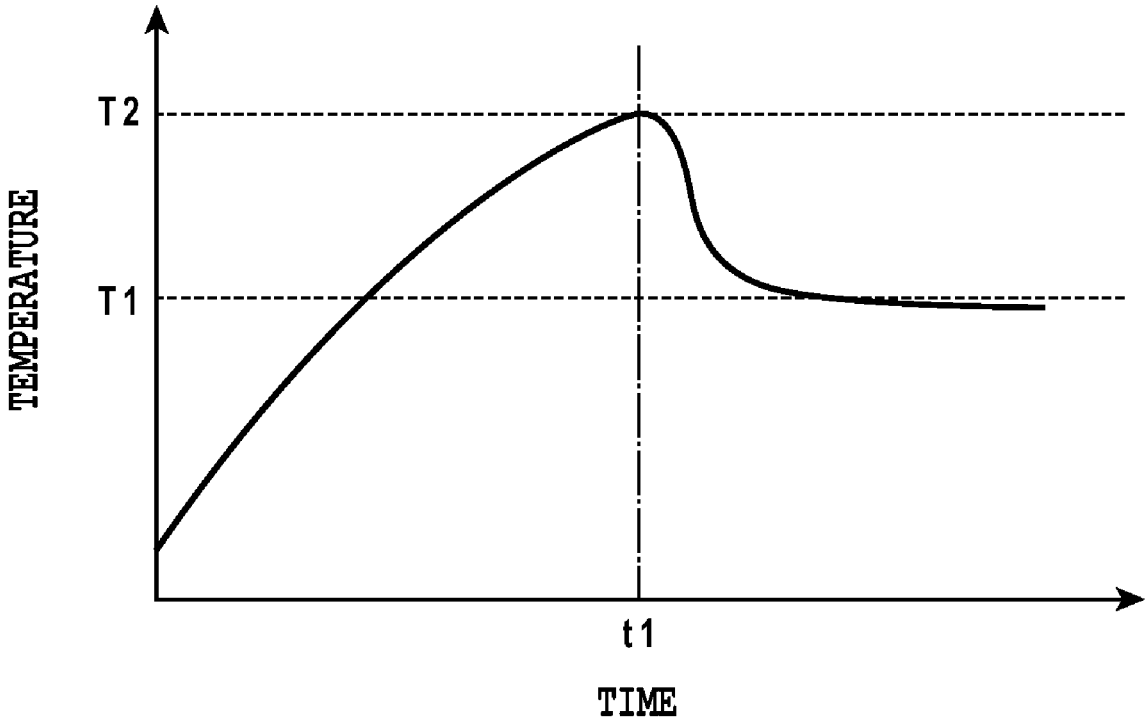
FIG. 5 is a graph showing a variation in hot air temperature observed when the dryer is started up.

FIG. 5 shows a variation in hot air temperature during start-up when the dryer 2 is shifted from a stopped or halted state to an operative state. The hot air temperature shown in FIG. 5 is detected by the temperature sensor 10. During start-up, the outside air adjustment mechanism 12 also shifts from the stopped state to the operative state. Furthermore, the outside air introduction amount increases from zero to a value corresponding to the droplet shoot amount. Hence, the heater 9 is controlled such that before time t1 when the outside air adjustment mechanism 12 shifts to the operative state to increase the outside air introduction amount, the hot air temperature is set to the second target temperature T2.

When the hot air temperature reaches the second target temperature T2 at time t1, the outside air adjustment mechanism 12 is simultaneously activated to start introducing the outside air. When the introduction of the outside air is started, the hot air temperature decreases. However, even after the decrease, the hot air temperature remains nearly at the first target temperature T1. On the other hand, when the hot air temperature reaches the second target temperature T2 at time t1, the target value for feedback control is simultaneously switched from the second target temperature T2 to the first target temperature T1. Thus, the hot air temperature is maintained nearly at the first target temperature T1.

Figure 6:
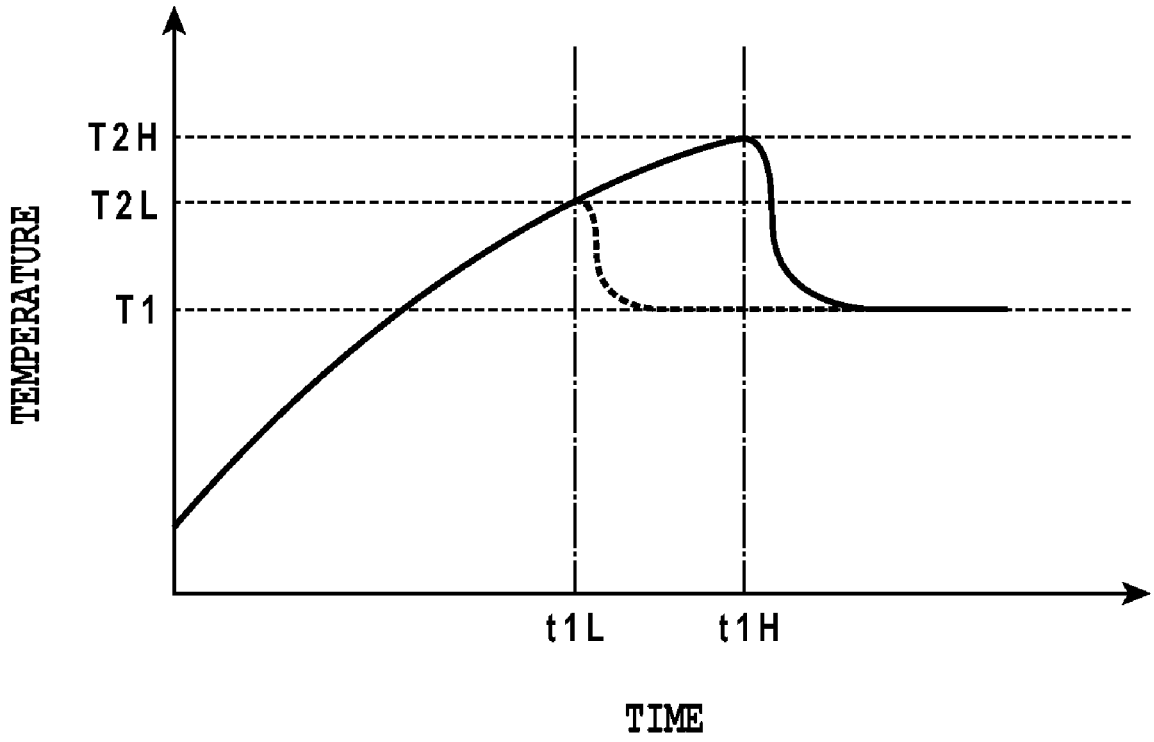
FIG. 6 is a graph showing a variation in hot air temperature observed when the dryer is started up, wherein a different amount of droplets are shot.

Like FIG. 5, FIG. 6 shows a variation in hot air temperature during start-up of the dryer 2. However, FIG. 6 differs from FIG. 5 in the second target temperature T2 because of a difference in droplet shoot amount. A second target temperature T2H for an increased droplet shoot amount is higher than a second target temperature T2L for a reduced droplet shoot amount. Thus, in connection with an actual timing for starting introduction of the outside air, a timing t1H for an increased droplet shoot amount is later than a timing t1L for a reduced droplet shoot amount.

Given that the second target temperature T2 is constant regardless of the droplet shoot amount, since the outside air introduction amount increases consistently with the droplet shoot amount, the hot air temperature decreases significantly immediately after the start of introduction of the outside air. Then, the hot air temperature may be lower than the first target temperature T1, temporarily preventing sufficient drying. Thus, when the value to which the second target temperature T2 is set is increased consistently with the droplet shoot amount, the first target temperature T1 can be maintained even with a decrease in hot air temperature.

In general, the droplet shoot amount often increases in keeping with the size of the print medium. Thus, an increase or decrease in droplet shoot amount can be determined based on the size of the print medium. That is, the following operation is possible. When the size of the print medium is increased, the droplet shoot amount is determined to have increased. Then, the outside air adjustment mechanism 12 is controlled so as to increase the outside air introduction amount.

Figure 7:
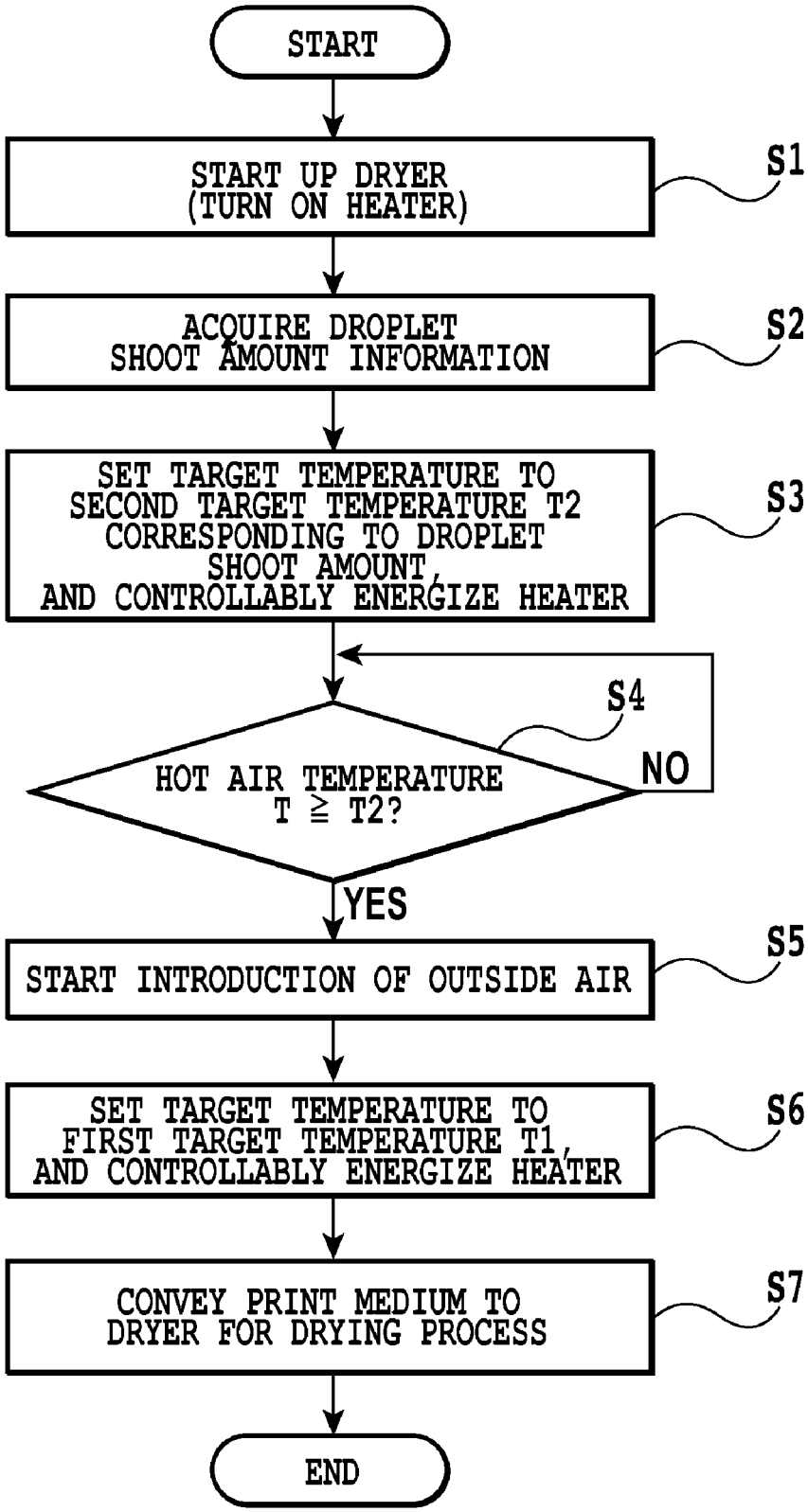
FIG. 7 is a flowchart showing control performed when the dryer is started up.

FIG. 7 is a flowchart showing a control (drying control) routine performed during start-up of the dryer 2. The routine is executed by the control device 4.

First, in step S1, the dryer 2 is started up. That is, the heater 9 is turned on to start being energized. The fan 8 may be turned on simultaneously with the turn-on of the heater or later when the heater 9 reaches a predetermined temperature.

In the step S2, the control device 4 acquires information (droplet shoot amount information) on the amount of droplets shot onto the print medium.

Then, in step S3, with reference to the map shown in FIG. 4, the second target temperature T2 and outside air introduction amount corresponding to the droplet shoot amount are set. Then, the heater 9 is controllably energized such that the hot air temperature T detected by the temperature sensor 10 is set to the second target temperature T2.

The process determines, in step 4, whether or not the hot air temperature T has reached the second target temperature T2, specifically, whether or not the hot air temperature T is equal to or higher than the second target temperature T2. If the hot air temperature T fails to have reached the second target temperature T2, the heater energization control is continued. If the hot air temperature T has reached the second target temperature T2, the process proceeds to step 5.

In step 5, the outside air adjustment mechanism 12 is turned on to start introduction of the outside air. At this time, the outside air adjustment mechanism 12 is controlled such that the actual outside air introduction amount is equal to the value set in step S3. Starting introduction of the outside air increases the actual outside air introduction amount from zero to a value corresponding to the droplet shoot amount.

Then, in step S6, the target temperature is set to the first target temperature T1, that is, switched from the second target temperature T2 to the first target temperature T1, with the heater energization control continued. In step S7, the printed print medium is conveyed from the apparatus main body 1 to the inside of the dryer 2, where a drying process is started and executed. Thus, the routine is finished.

Now, an example will be described in which the amount of droplet shot onto the print medium increases during a normal operation of the dryer 2 and in which the outside air introduction amount is thus correspondingly increased.

If the droplet shoot amount is switched to the increase direction during a normal operation of the dryer, the outside air introduction amount is increased to suppress a rise in humidity caused by an increase in shoot amount. At this time, since an increase in outside air introduction amount reduces the hot air temperature, the drying may be temporarily insufficient. Thus, in the present embodiment, before an actual increase in outside air introduction amount, the hot air target temperature is switched to the second target temperature T2 specified in accordance with the droplet shoot amount. The outside air introduction amount is increased after the actual hot air temperature has reached the second target temperature T2. Then, even when reduced, the hot air temperature can be maintained nearly at the first target temperature T1.

Figure 8:
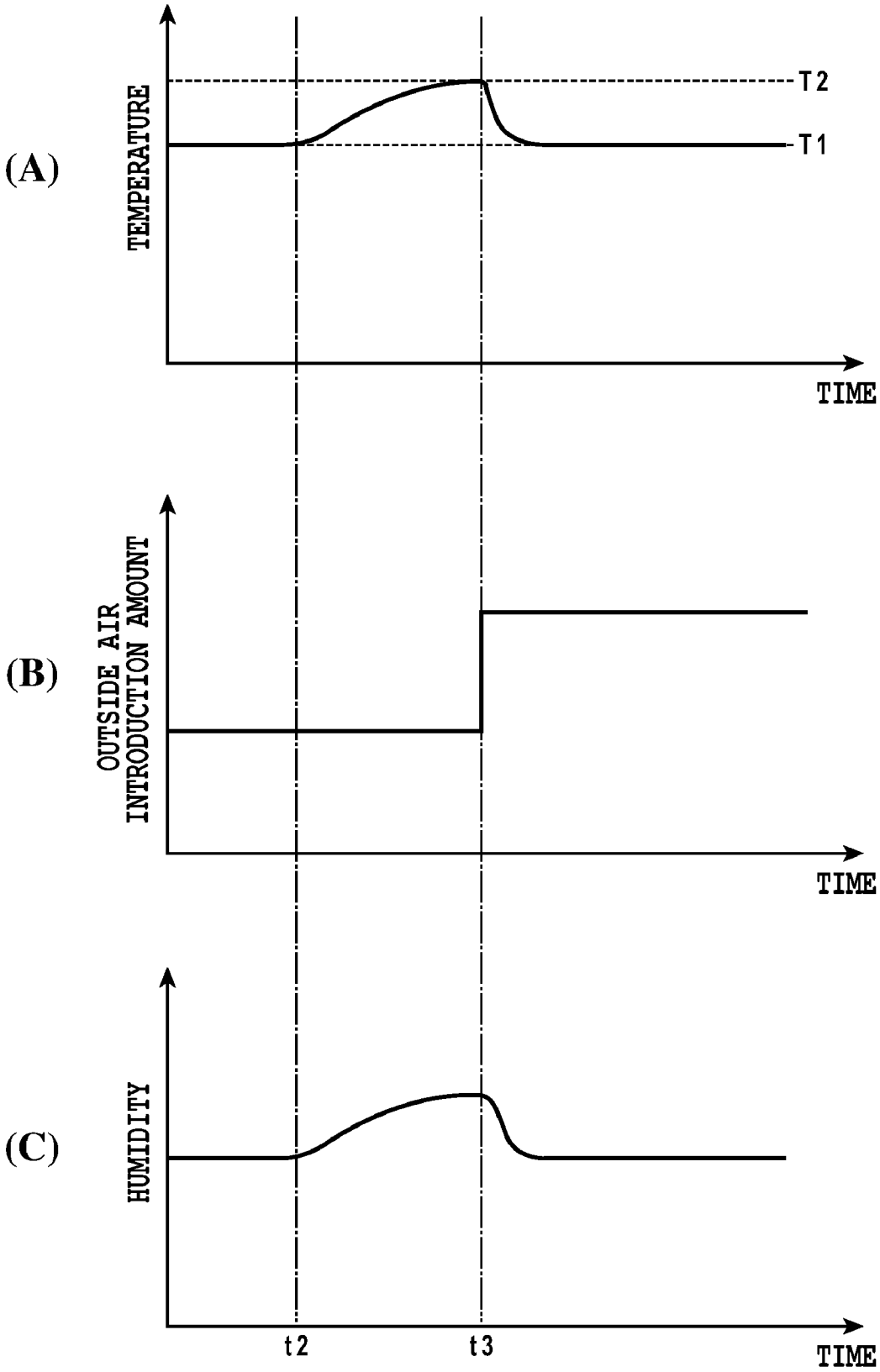
FIG. 8 is a time chart showing a variation in each value observed if the droplet shoot amount changes during a normal operation of the dryer.

FIG. 8 shows variations in (A) hot air temperature, (B) outside air introduction amount, and (C) internal humidity observed when the droplet shoot amount increases during a normal operation of the dryer 2. Before time t2, the hot air temperature is controlled to the first target temperature Ti, and the outside air introduction amount is controlled to a value corresponding to the current droplet shoot amount. At time T2, the droplet shoot amount increases. Then, first, with reference to the map shown in FIG. 4, the control device 4 controllably energizes the heater 9 so that the actual hot air temperature is raised to the second target temperature T2 corresponding to the increased droplet shoot amount. At time T3 when the hot air temperature reaches the second target temperature T2, the control device 4 controllably energizes the outside air adjustment mechanism 12 so that the actual outside air introduction amount is increased to the value corresponding to the increased droplet shoot amount.

At time t2, humidity increases gradually and consistently with the droplet shoot amount. However, when the outside air introduction amount is increased at time t3, the humidity is reduced. Thus, a rise in the humidity in the dryer can be suppressed even with an increase in droplet shoot amount.

Figure 9:
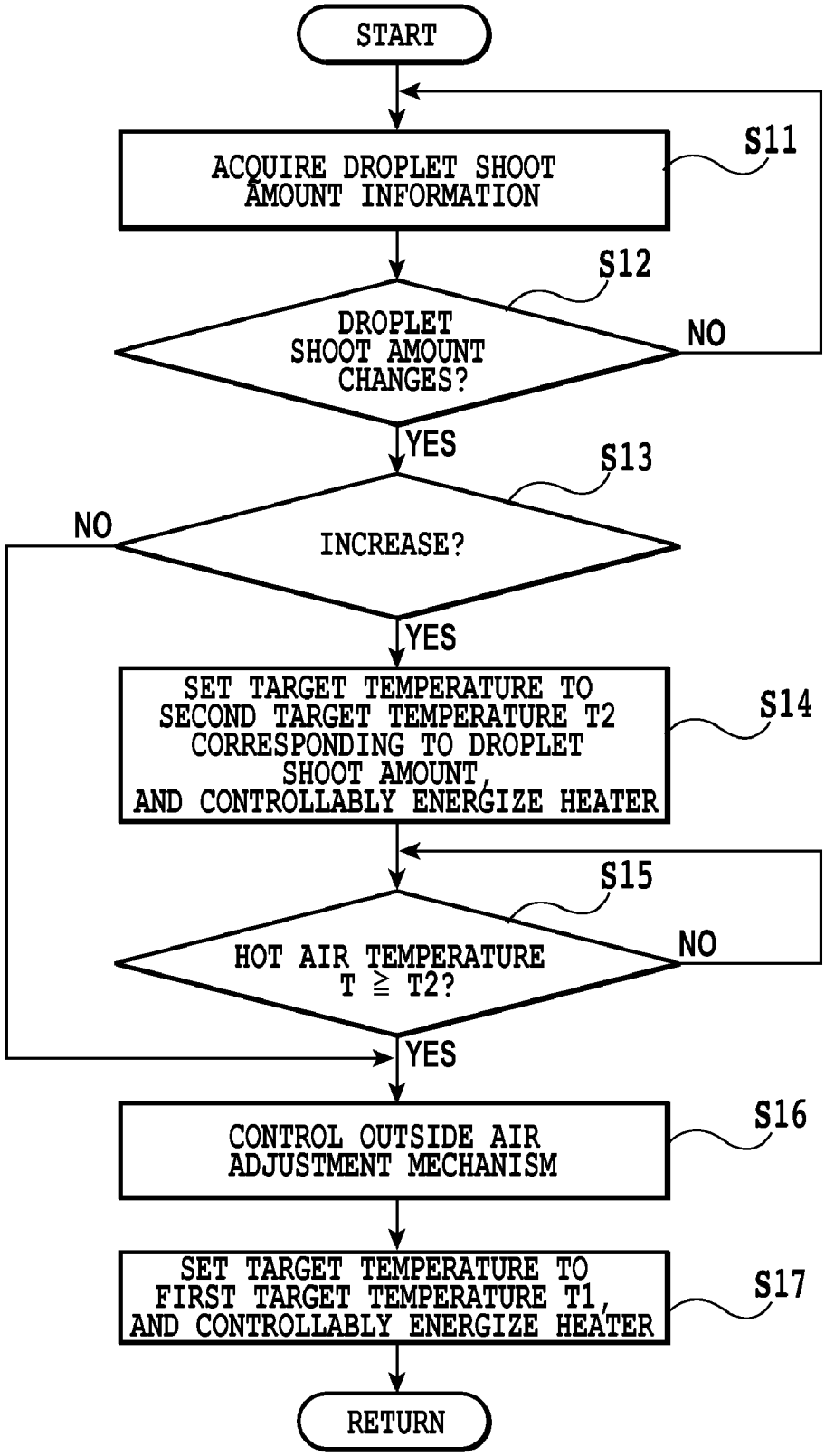
FIG. 9 is a flowchart showing control performed during the normal operation of the dryer.

FIG. 9 is a flowchart showing a control (drying control) routine performed during a normal operation of the dryer 2. The routine is executed by the control device 4.

First, in step S11, the control device 4 acquires information (droplet shoot information) on the amount of droplets shot onto the print medium.

Then, step S12 determines, based on the droplet shoot amount information, whether or not the droplet shoot amount has changed. If no change has occurred, the process returns to step S11. On the other hand, if a change has occurred, the process proceeds to step S13.

Then, the process determines, in step S13, whether or not the change in droplet shoot amount corresponds to an increase in droplet shoot amount. If the change corresponds to an increase, the process proceeds to step S14. On the other hand, if the change does not correspond to an increase (but to a decrease), the process proceeds to step S16.

In step S14, with reference to the map shown in FIG. 4, the second target temperature T2 and outside air introduction amount corresponding to the increased droplet shoot amount are set. Then, the heater 9 is controllably energized such that the hot air temperature T2 detected by the temperature sensor 10 is set to the second target temperature T2. Thus, the hot air temperature is raised.

The process determines, in step S15, whether or not the hot air temperature has reached the second target temperature T2, specifically, whether or not the hot air temperature T is equal to or higher than the second target temperature T2. If the hot air temperature T fails to have reached the second target temperature T2, the heater energization control is continued. If the hot air temperature T has reached the second target temperature T2, the process proceeds to step 16.

In step S16, the outside air adjustment mechanism 12 is controlled such that the actual outside air introduction amount equals the set outside air introduction amount. If the droplet shoot amount has increased, the outside air adjustment mechanism 12 is controlled so as to increase the outside air introduction amount.

Then, in step S17, the target temperature is set to the first target temperature T1, and the heater energization control is continued. The above-described routine is repeatedly executed during operation of the dryer.

On the other hand, if the process determines that the change in droplet shoot amount corresponds to an increase in droplet shoot amount, the process skips steps S14 and S15 and proceeds to step S16. In this case, the second target temperature T2 corresponding to the reduced droplet shoot amount is not set but only the outside air introduction amount corresponding to the reduced droplet shoot amount is set. The outside air adjustment mechanism 12 is then controlled such that the actual outside air introduction amount equals the set outside air introduction amount.

If the droplet shoot amount decreases, the target value for the outside air introduction amount is reduced in accordance with the map shown in FIG. 4. Thus, the actual outside air introduction amount is also reduced. Then, since the hot air temperature tends to rise, no control is performed such that the hot air temperature is pre-raised.

Then, in step S17, the target temperature is set to the first target temperature T1, and the heater energization control is continued. Even if the hot air temperature rises temporarily with decreasing droplet shoot amount, the control to the first target temperature T1 allows the hot air temperature to lower.

Thus, according to the present embodiment, before an actual increase in outside air introduction amount, the hot air temperature is raised to the second target temperature T2. Thus, even if the outside air introduction amount is actually increased to temporarily lower the hot air temperature, the hot air temperature can be maintained nearly at the first target temperature T1. Hence, degradation of the drying capability can be suppressed.

The present embodiment can be additionally configured as follows. That is, the dryer further includes a shutter mechanism configured to open and close at least one of an inlet and an outlet through which the print medium passes, in accordance with the size of the print medium.

Figure 10A:
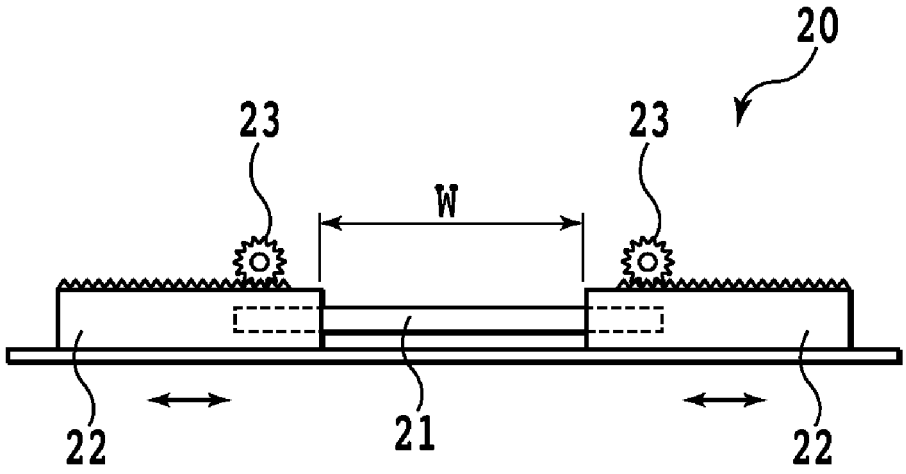
FIGS. 10A and 10B are diagrams showing a shutter mechanism.
Figure 10B:
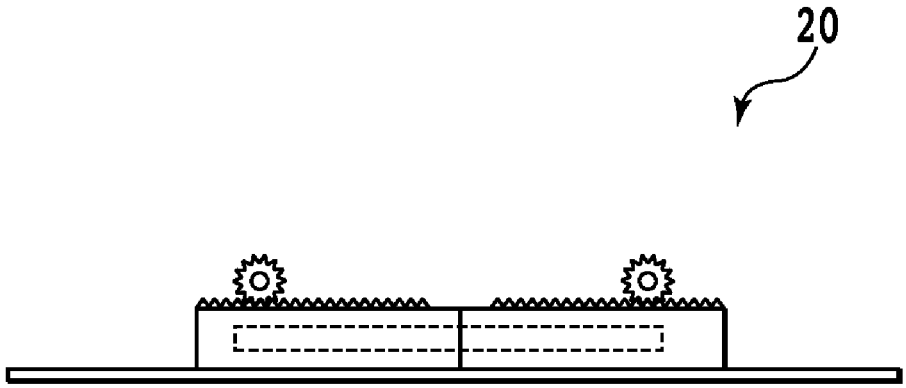

FIGS. 10A and 10B show a shutter mechanism 20 provided at the outlet portion for the print medium. FIG. 10A shows that the shutter mechanism 20 is open. FIG. 10B shows that the shutter mechanism 20 is fully closed. Reference numeral 21 denotes an outlet for the print medium provided on a casing of the dryer 2. The print medium discharged through the outlet 21 is collected in the discharge section 11 (FIG. 1). The shutter mechanism 20 opens and closes the outlet 21 inside the dryer 21.

The shutter mechanism 20 may be provided at the inlet for the print medium provided on the casing of the dryer 2, that is, at a port for communication with the apparatus main body 1, or outside the dryer 1.

The shutter mechanism 20 includes paired shutter valves 22 that can move so as to approach and leave each other in the width direction of the outlet 21, and paired driving sections 23 configured to drive the shutter valves 22. The driving sections 23 transmit the rotational driving force of the motor to the shutter valves 22 via rack and pinion mechanisms to reciprocate the shutter valves 22.

The driving sections 23 are controlled by the control device 4. The control device 4 controls the driving sections 23 and thus the shutter mechanism 20 so that the gap between the shutter valves 22 and thus the opening width W of the outlet 21 equal the width of the print medium.

In this case, for large-sized print media that tend to have large droplet shoot amounts, the opening width of the outlet 21 is significantly increased. This also increases the amount of outside air introduced through the outlet 21, allowing a rise in humidity to be effectively suppressed in accordance with the droplet shoot amount.

On the other hand, during start-up of the dryer 2, the control device 4 controls the driving sections 23 so that the shutter mechanism 20 is fully closed as shown in FIG. 10B. At this time, the shutter valves 22 are brought into abutting contact with each other at the widthwise central position of the outlet 21. Thus, the opening width W of the outlet 21 is set to zero.

Then, the introduction of the outside air through the outlet 21 is substantially eliminated. Thus, the temperature in the dryer 2 and thus the hot air temperature can be quickly raised. The shutter mechanism need not necessarily be fully closed, but may be open to the degree that a rise in internal temperature can be promoted.

The embodiment of the present invention has been described. However, other embodiments of the present invention are possible. For example, in the above-described embodiment, the hot air temperature is feedback-controlled. However, feedforward control may be used.

Furthermore, the present invention can be implemented using the following processing. That is, software (program) configured to implement the functions of the above-described embodiment is supplied to a system or an apparatus via a network or any storage medium. A computer (CPU, MPU, or the like) in the system or apparatus reads and executes the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-211843, filed Sep. 14, 2009, which is hereby incorporated by reference herein in its entirety.

What is claimed is:

1. An ink jet printing apparatus comprising:

a printing unit configured to allow a print head to eject ink onto a print medium to form an image;

a dryer unit configured to dry the ink on the print medium conveyed from the printing unit, the dryer unit having a heater provided inside of the dryer unit and a mechanism to introduce outside air into the inside of the dryer unit; and a control unit configured to control the heater and the mechanism of the drying unit, wherein the control unit is able to perform controlling of the heater so that temperature in the dryer unit is set to a first target temperature without changing the mechanism, and controlling of the heater so that the temperature in the dryer unit is pre-raised to a second target temperature higher than the first target temperature before increasing an amount of air introduced from the outside by the mechanism.

2. The ink jet printing apparatus according to claim 1, wherein the control unit controls the mechanism so that the introduced air is increased when the dryer unit is started up, when an ink ejection amount increases or when a size of the print medium is increased.

3. The ink jet printing apparatus according to claim 1, wherein the control unit sets the second target temperature to be higher with an increase in an ink ejection amount.

4. The ink jet printing apparatus according to claim 1, wherein the control unit controls the mechanism so that an amount of the introduced air is increased when the temperature in the dryer unit reaches the second target temperature, and thereafter, the control unit controls the heater so that the temperature in the dryer unit reaches the first target temperature.

5. The ink jet printing apparatus according to claim 1, further comprising a detection unit configured to detect the temperature in the dryer unit, wherein the control unit feedback-controls the heater based on the temperature detected by the detection unit.

6. The ink jet printing apparatus according to claim 1, wherein the dryer unit further comprises a shutter mechanism configured to open and close at least one of an inlet and an outlet through which the print medium passes, in accordance with the size of the print medium.

7. The ink jet printing apparatus according to claim 1, wherein the mechanism comprises a port and a fan provided in a vicinity of the port, and wherein a rotation speed of the fan is variably controlled by the control unit.

8. The ink jet printing apparatus according to claim 1, wherein the mechanism comprises a port and a shutter valve provided in a vicinity of the port, and wherein an opening of the shutter valve is variably controlled by the control unit.

* * * * *